US011804170B2

(12) United States Patent
Kim et al.

(10) Patent No.: US 11,804,170 B2
(45) Date of Patent: Oct. 31, 2023

(54) DISPLAY DEVICE AND DRIVING METHOD THEREOF

(71) Applicant: Samsung Display Co., Ltd., Yongin-Si (KR)

(72) Inventors: Hyuk Kim, Yongin-si (KR); Yang Hwa Choi, Yongin-si (KR); Jung Hwan Hwang, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/517,734

(22) Filed: Nov. 3, 2021

(65) Prior Publication Data

US 2022/0335881 A1 Oct. 20, 2022

(30) Foreign Application Priority Data

Apr. 19, 2021 (KR) ..... 10-2021-0050646

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2320/0247* (2013.01); *G09G 2340/0435* (2013.01)

(58) Field of Classification Search
CPC ..... G09G 3/32; G09G 2320/0247; G09G 2340/0435; G09G 3/3233
See application file for complete search history.

(56) References Cited

U.S. PATENT DOCUMENTS

| | | | | |
|---|---|---|---|---|
| 9,058,786 | B2 * | 6/2015 | Keitaro | G09G 3/3648 |
| 9,152,252 | B2 * | 10/2015 | Han | G06F 3/038 |
| 9,320,967 | B2 | 4/2016 | Knutsson | |
| 9,417,683 | B2 * | 8/2016 | Nakayama | G09G 3/3688 |
| 9,496,319 | B2 | 11/2016 | Jeon | |
| 9,886,899 | B2 * | 2/2018 | Azizi | G06F 1/3218 |
| 9,886,923 | B2 * | 2/2018 | Wu | G09G 3/3648 |
| 9,972,250 | B2 * | 5/2018 | Toyomura | G09G 3/3266 |
| 10,325,552 | B2 * | 6/2019 | Jeong | G09G 3/3225 |
| 10,818,253 | B2 * | 10/2020 | Park | G09G 3/3648 |
| 10,891,903 | B2 | 1/2021 | Takasugi | |
| 11,030,950 | B2 * | 6/2021 | Kwon | G09G 3/3275 |

(Continued)

FOREIGN PATENT DOCUMENTS

| | | | |
|---|---|---|---|
| KR | 10-2018-0127896 | A | 11/2018 |
| KR | 10-2074719 | B1 | 2/2020 |
| KR | 10-2195863 | B1 | 12/2020 |

*Primary Examiner* — Michael J Jansen, II
(74) *Attorney, Agent, or Firm* — Innovation Counsel LLP

(57) ABSTRACT

A display device of the present inventive concept includes a processor supplying grayscale data in active periods of frame periods and stopping supply of the grayscale data in blank periods of the frame periods; a switch controller generating a first switch control signal when a blank period is longer than a predetermined period, and generating a second switch control signal when the blank period ends; a power supply supplying a voltage different from a first power voltage to a first power line when the first switch control signal is received and supplying the first power voltage to the first power line when the second switch control signal is received; and pixels commonly connected to the first power line.

16 Claims, 10 Drawing Sheets

(56) References Cited

U.S. PATENT DOCUMENTS

| | | | | |
|---|---|---|---|---|
| 2008/0238833 | A1* | 10/2008 | Hioki | G09G 3/3233 345/76 |
| 2011/0084950 | A1* | 4/2011 | Keitaro | G09G 3/3648 345/98 |
| 2014/0071112 | A1* | 3/2014 | Han | G09G 3/325 345/212 |
| 2014/0080560 | A1* | 3/2014 | Knutsson | A63F 13/573 463/10 |
| 2015/0054811 | A1* | 2/2015 | Azizi | G06F 1/3218 345/211 |
| 2015/0097872 | A1 | 4/2015 | Jeong et al. | |
| 2015/0138254 | A1* | 5/2015 | Nakayama | G06F 1/3265 345/690 |
| 2015/0279279 | A1* | 10/2015 | Toyomura | G09G 3/3266 345/212 |
| 2016/0079317 | A1* | 3/2016 | Jeon | G09G 3/3233 315/115 |
| 2017/0061860 | A1* | 3/2017 | Park | G09G 3/3648 |
| 2017/0162142 | A1* | 6/2017 | Wu | G09G 3/3648 |
| 2019/0180688 | A1* | 6/2019 | Yang | G09G 3/3258 |
| 2019/0189060 | A1* | 6/2019 | Takasugi | G09G 3/3275 |
| 2020/0027398 | A1* | 1/2020 | Kwon | G09G 3/3275 |
| 2022/0037418 | A1* | 2/2022 | Han | H10K 59/40 |

* cited by examiner

DISPLAY DEVICE AND DRIVING METHOD THEREOF

CROSS-REFERENCE TO RELATED APPLICATION

The application claims priority to and the benefit of Korean Patent Application No. 10-2021-0050646, filed Apr. 19, 2021, which is hereby incorporated by reference for all purposes as if fully set forth herein.

BACKGROUND

1. Field

The present inventive concept relates to a display device and a driving method thereof.

2. Discussion

With the development of information technology, the importance of display devices, which is are a connection medium between users and information, has been emphasized. In response to this, the use of display devices such as a liquid crystal display device, an organic light emitting display device, and the like has been increasing.

Recently, according to consumer demand, a display device may display an image at various display frequencies. However, when a display frequency is changed, flicker may occur even in the image of the same grayscale.

To this end, a method of using different data voltages for the same grayscale when the display frequency is changed has been proposed. However, since it takes one frame to detect the display frequency, there is a problem in that a difference in luminance of at least one frame is visually recognized by a user. In order to further solve this problem, a method of displaying an image with a delay by one frame has been proposed, but has a disadvantage in that a separate frame memory is required.

SUMMARY

A technical problem to be solved is to provide a display device capable of preventing flicker when a display frequency is changed without a frame memory, and a driving method thereof.

A display device according to an embodiment of the present inventive concept may include a processor supplying grayscale data in active periods of frame periods and stopping supply of the grayscale data in blank periods of the frame periods; a switch controller generating a first switch control signal when a blank period is longer than a predetermined period, and generating a second switch control signal when the blank period ends; a power supply supplying a voltage different from a first power voltage to a first power line when the first switch control signal is received and supplying the first power voltage to the first power line when the second switch control signal is received; and pixels commonly connected to the first power line.

The power supply may supply a second power voltage to the first power line when the first switch control signal is received, and the pixels may be commonly connected to a second power line to which the second power voltage is applied.

The first power voltage may be greater than the second power voltage.

The power supply may supply a reference voltage to the first power line when the first switch control signal is received, the pixels may be commonly connected to the second power line to which the second power voltage is applied, and the reference voltage may be different from the first power voltage and the second power voltage.

The first power voltage may be greater than the reference voltage.

Lengths of the active periods of the frame periods may be equal to each other, and at least two of the blank periods of the frame periods may have different lengths.

The blank periods may include a first blank period and a second blank period. The first power line may maintain the first power voltage during the first blank period. The first power line may maintain the first power voltage during a first period of the second blank period, and the first power line may maintain the voltage different from the first power voltage during a second period of the second blank period. The first period may be longer than the first blank period.

The blank periods may further include a third blank period. The first power line may maintain the first power voltage during a third period of the third blank period, and the first power line may maintain the voltage different from the first power voltage during a fourth period of the third blank period. Lengths of the third period and the first period may be equal to each other, and the fourth period may be longer than the second period.

The pixels may be in a non-emission state during the second period and the fourth period.

The switch controller may include a counter generating a low frequency detection signal when the blank period is longer than the predetermined period; and a switch control signal generator generating the first switch control signal when the low frequency detection signal is received and generating the second switch control signal when a scan start signal is received.

The counter may generate the low frequency detection signal when a data enable signal having a disable level is longer than the predetermined period.

The counter may generate the low frequency detection signal when a time for which a vertical synchronization signal is maintained at a disabled level is longer than the predetermined period.

The display device may further include a scan driver sequentially providing scan signals of a turn-on level to scan lines connected to the pixels when the scan start signal is received.

The power supply may include a first power source generating the first power voltage; a second power source generating the second power voltage; and a switch connecting the first power line to the second power line when the first switch control signal is received, and connecting the first power line to the first power source when the second switch control signal is received.

The power supply may include a first power source generating the first power voltage; a second power source generating the second power voltage; and a switch applies the reference voltage to the first power line when the first switch control signal is received, and connecting the first power line to the first power source when the second switch control signal is received.

A driving method of a display device according to an embodiment of the present invention may include supplying grayscale data in an active period of a frame period and stopping supply of the grayscale data in a blank period of the frame period by a processor; generating a first switch control signal by a switch controller when the blank period is longer than a predetermined period; supplying a voltage different from a first power voltage to a first power line by a power supply unit when the first switch control signal is received; receiving the voltage different from the first power voltage by pixels commonly connected to the first power line; generating a second switch control signal by the switch controller when the blank period ends; supplying the first power voltage to the first power line by the power supply unit when the second switch control signal is received; and receiving the first power voltage by the pixels.

The processor may supply the grayscale data in active periods of frame periods and stop supply of the grayscale data in blank periods of the frame periods, lengths of the active periods may be equal to each other, and at least two of the blank periods may have different lengths.

The blank periods may include a first blank period and a second blank period. The first power line may maintain the first power voltage during the first blank period. The first power line may maintain the first power voltage during a first period of the second blank period, and the first power line may maintain the voltage different from the first power voltage during a second period of the second blank period. The first period may be longer than the first blank period.

The blank periods may further include a third blank period. The first power line may maintain the first power voltage during a third period of the third blank period, and the first power line may maintain the voltage different from the first power voltage during a fourth period of the third blank period. Lengths of the third period and the first period may be equal to each other, and the fourth period may be longer than the second period.

The pixels may be in a non-emission state during the second period and the fourth period.

BRIEF DESCRIPTION OF THE DRAWINGS

The accompanying drawings, which are included to provide a further understanding of the inventive concepts, and are incorporated in and constitute a part of this specification, illustrate embodiments of the inventive concepts, and, together with the description, serve to explain principles of the inventive concepts.

DETAILED DESCRIPTION OF THE ILLUSTRATED EMBODIMENTS

Figure 1:
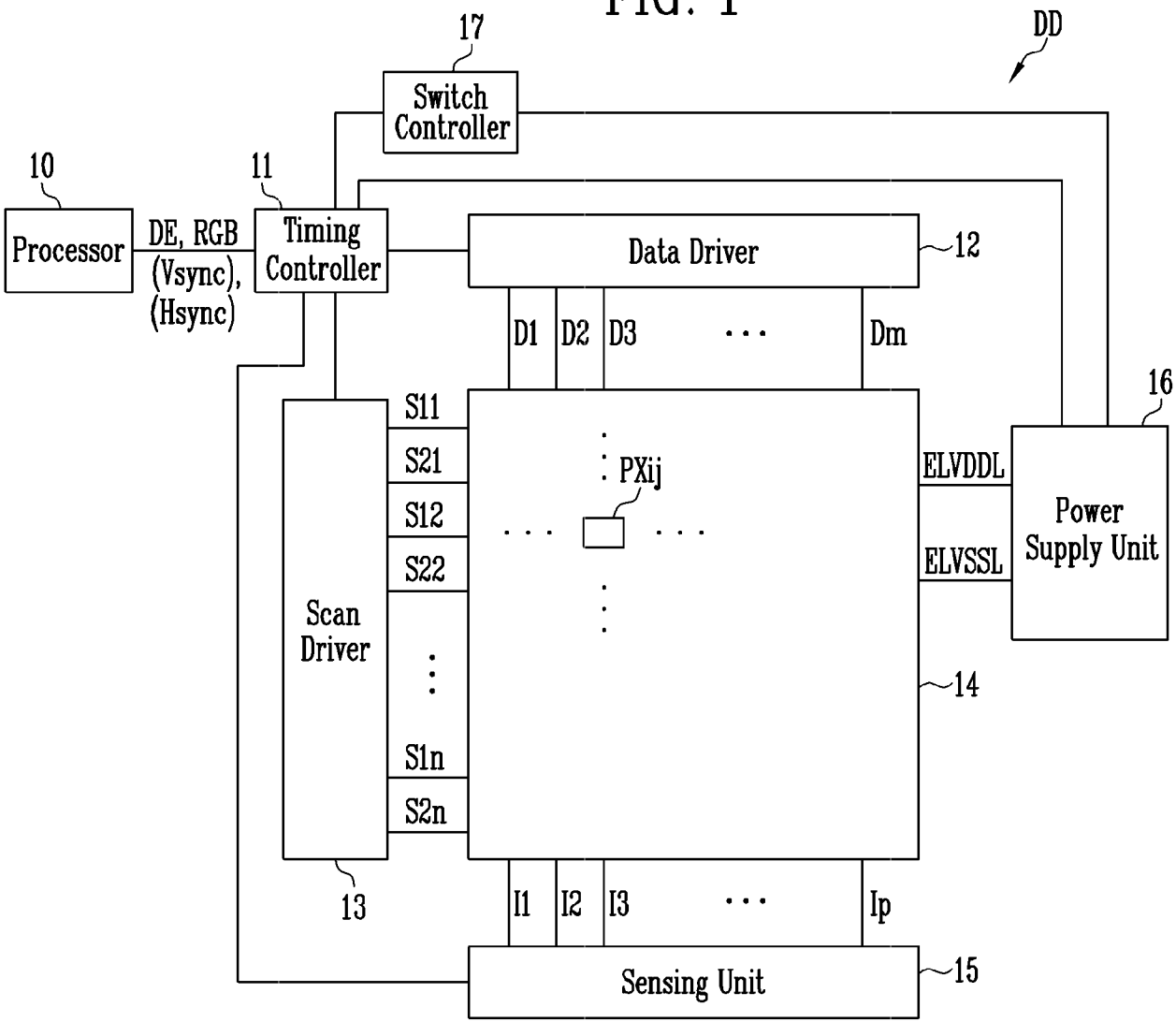
FIG. 1 is a diagram for explaining a display device according to an embodiment of the present inventive concept.

Hereinafter, various embodiments of the present inventive concept will be described in detail with reference to the accompanying drawings so that those of ordinary skill in the art may easily implement the present inventive concept. The present inventive concept may be embodied in various different forms and is not limited to the embodiments described herein.

In order to clearly describe the present inventive concept, parts that are not related to the description are omitted, and the same or similar components are denoted by the same reference numerals throughout the specification. Therefore, the reference numerals described above may also be used in other drawings.

In addition, in the description, the expression "is the same" may mean "substantially the same". That is, it may be the same enough to convince those of ordinary skill in the art to be the same. In other expressions, "substantially" may be omitted.

FIG. 1 is a diagram for explaining a display device according to an embodiment of the present inventive concept.

Referring to FIG. 1, a display device DD according to an embodiment of the present inventive concept may include a processor 10, a timing controller 11, a data driver 12, a scan driver 13, a plurality of pixels 14, a sensor 15, a power supply 16, and a switch controller 17.

The processor 10 may supply a data enable signal DE and grayscale data RGB to the timing controller 11. According to an embodiment, the processor 10 may supply a vertical synchronization signal Vsync and a horizontal synchronization signal Hsync to the timing controller 11. The processor 10 may be composed of a graphics processing unit (GPU), a central processing unit (CPU), an application processor (AP), and the like. The processor 10 may be one IC (integrated circuit) chip or a group composed of a plurality of ICs.

The processor 10 may generate the grayscale data RGB for each image by performing rendering.

The processor 10 may supply the grayscale data RGB to the timing controller 11 in active periods of frame periods, and may stop the supply of the grayscale data RGB to the timing controller 11 in blank periods of the frame periods. In this case, the processor 10 may use the data enable signal DE to notify whether the grayscale data RGB is supplied. For example, the data enable signal DE may be at an enable level while the grayscale data RGB is supplied, and may be at a disable level during the blank periods. For example, the data enable signal DE may include pulses having the enable level in each horizontal period during the active period. The grayscale data RGB may be supplied to the timing controller 11 in units of horizontal lines in response to a pulse of the enable level of the data enable signal DE. A horizontal line may mean pixels connected to the same scan line (for example, a pixel row).

Each cycle of the vertical synchronization signal Vsync may correspond to each frame period. For example, the vertical synchronization signal Vsync may have an enable level (for example, a logic high level) during an active period of a corresponding frame period may have a disable level (for example, a logic low level) during a blank period. Each cycle of the horizontal synchronization signal Hsync may correspond to each horizontal period.

The timing controller 11 may receive the data enable signal DE and the grayscale data RGB from the processor 10. According to an embodiment, the timing controller 11 may further receive the vertical synchronization signal Vsync and the horizontal synchronization signal Hsync from the processor 10.

The timing controller 11 may supply control signals which suits for specifications of the data driver 12, the scan driver 13, the sensor 15, the power supply 16, and the switch controller 17. Also, the timing controller 11 may provide processed or unprocessed grayscale data RGB to the data driver 12.

The data driver 12 may generate data voltages to be provided to data lines D1, D2, D3, and Dm using the grayscale data RGB and the control signals. For example, the data driver 12 may sample the grayscale data RGB using a clock signal, and may supply the data voltages corresponding to the grayscale data RGB to the data lines D1 to Dm one row at a time, where m may be an integer greater than 0.

The scan driver 13 may receive a clock signal, a scan start signal, and the like from the timing controller 11 and generate first scan signals to be provided to first scan lines S11, S12, and S1*n* and second scan signals to be provided to second scan lines S21, S22, and S2*n*, where n may be an integer greater than 0.

The scan driver 13 may sequentially supply the first scan signals having a turn-on level pulse to the first scan lines S11, S12, and S1*n*. Also, the scan driver 13 may sequentially supply the second scan signals having the turn-on level pulse to the second scan lines S21, S22, and S2*n*.

For example, the scan driver 13 may include scan stages including shift registers. Each of the scan stages may be connected to a corresponding first scan line and a corresponding second scan line. For example, when the scan start signal of an enable level (for example, a turn-on level) is received, a first scan stage may provide a first scan signal of a turn-on level to a first scan line S11 and a second scan signal of the turn-on level to a second scan line S21. When a carry signal (or scan signal) of an enable level (for example, a turn-on level) of a previous scan stage is received, the second and subsequent scan stages may provide the first scan signal of the turn-on level to the connected first scan line and the second scan signal of the turn-on level to the connected second scan line.

The sensor 15 may receive a control signal from the timing controller 11 and supply an initialization voltage to sensing lines I1, I2, I3, and Ip (here, p may be an integer greater than 0) or receive a sensing signal. For example, the sensor 15 may supply the initialization voltage to the sensing lines I1, I2, I3, and Ip during at least a part of a display period. For example, the sensor 15 may receive the sensing signal through the sensing lines I1, I2, I3, and Ip during at least a part of a sensing period.

The sensor 15 may include sensing channels connected to the sensing lines I1, I2, I3, and Ip. For example, the sensing lines I1, I2, I3, and Ip and the sensing channels may correspond one-to-one.

Each pixel PXij of the plurality of pixels 14 may be connected to a corresponding data line, a corresponding scan line, and a corresponding sensing line. A structure of the pixel PXij will be described later with reference to FIG. 3.

The power supply 16 may be connected to the pixels through a first power line ELVDDL and a second power line ELVSSL. The pixels may be commonly connected to the first power line ELVDDL and the second power line ELVSSL. In general, the power supply 16 may supply a first power voltage through the first power line ELVDDL and a second power voltage through the second power line ELVSSL. For example, during the display period of the plurality of pixels 14, a voltage of the first power line ELVDDL may be greater than a voltage of the second power line ELVSSL.

The switch controller 17 may generate a first switch control signal when the blank period is longer than a predetermined period and generate a second switch control signal when the blank period ends. The switch controller 17 may maintain the second switch control signal during the blank period when the blank period is smaller than the predetermined period.

The power supply 16 may supply a voltage different from the first power voltage to the first power line ELVDDL when the first switch control signal is received, and supply the first power voltage to the first power line ELVDDL when the second switch control signal is received. The power supply 16 may supply the second power voltage to the second power line ELVSSL regardless of the first and second switch control signals.

Figure 2:
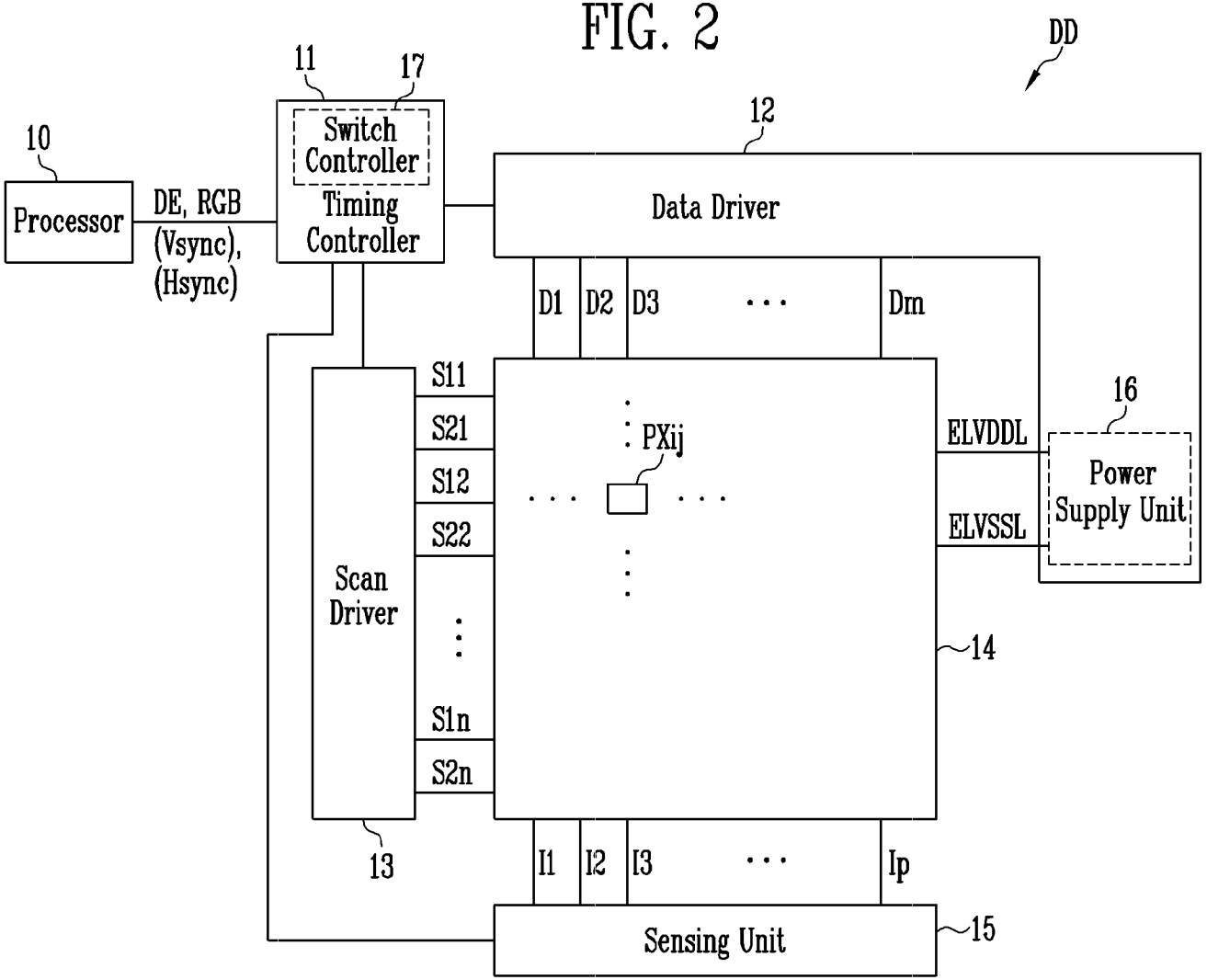
FIG. 2 is a diagram for explaining a display device according to another embodiment of the present inventive concept.

FIG. 2 is a diagram for explaining a display device according to another embodiment of the present inventive concept.

Referring to FIG. 2, the switch controller 17 and the timing controller 11 may be integrated as a single integrated circuit (IC) chip. For example, the switch controller 17 may be implemented in hardware or software as a part of the timing controller 11.

In addition, the power supply 16 and the data driver 12 may be configured as a single IC chip. For example, the power supply 16 may be implemented in hardware or software as a part of the data driver 12.

Although not shown, according to an embodiment, the timing controller 11 and the data driver 12 may be integrated as a single IC chip. Also, although not shown, according to an embodiment, the data driver 12 and the sensor 15 may be integrated as a single IC chip.

Figure 3:
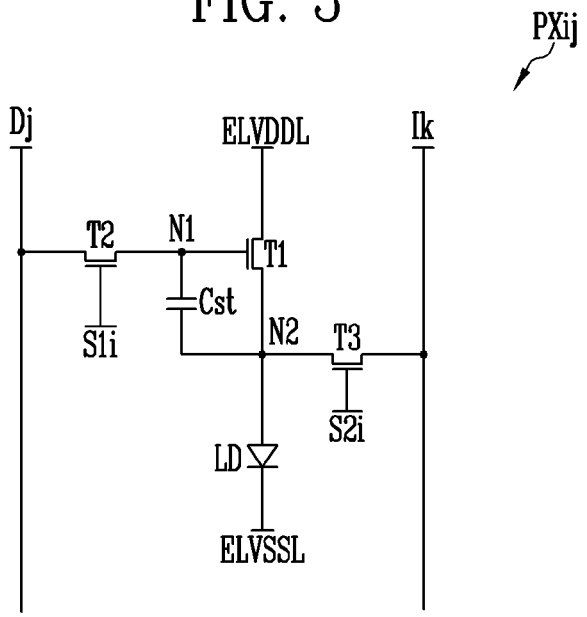
FIG. 3 is a diagram for explaining a pixel according to an embodiment of the present inventive concept.
Figure 4:
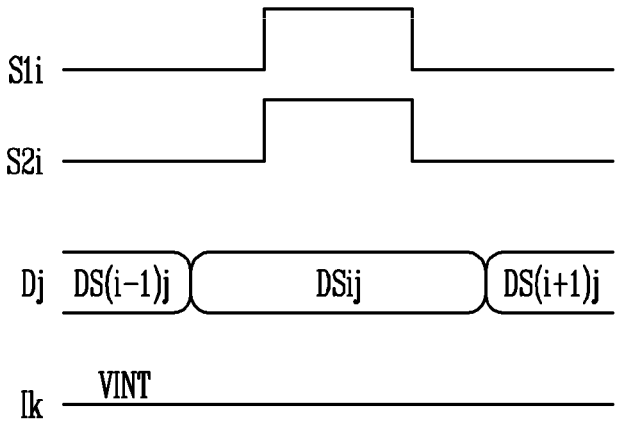
FIG. 4 is a diagram for explaining a driving method of the pixel according to an embodiment of the present inventive concept.

FIG. 3 is a diagram for explaining a pixel according to an embodiment of the present inventive concept. FIG. 4 is a diagram for explaining a driving method of the pixel according to an embodiment of the present inventive concept.

Referring to FIG. 3, the pixel PXij may include transistors T1, T2, and T3, a storage capacitor Cst, and a light emitting diode LD.

The transistors T1, T2, and T3 may be configured as N-type transistors. In another embodiment, the transistors T1, T2, and T3 may be configured as P-type transistors. In another embodiment, the transistors T1, T2, and T3 may be configured as a combination of an N-type transistor and a P-type transistor. The P-type transistor may generally refer to a transistor in which the amount of current flowing through the transistor increases when a voltage difference between a gate electrode and a source electrode increases in a negative direction. The N-type transistor may generally refer to a transistor in which the amount of current flowing through the transistor increases when the voltage difference between the gate electrode and the source electrode increases in a positive direction. The transistors may be a thin film transistor (TFT), a field effect transistor (FET), or a bipolar junction transistor (BJT).

A first transistor T1 may have a gate electrode connected to a first node N1, a first electrode connected to the first power line ELVDDL, and a second electrode connected to a second node N2. The first transistor T1 may be referred to as a driving transistor.

A second transistor T2 may have a gate electrode connected to a first scan line S1*i*, a first electrode connected to a data line Dj, and a second electrode connected to the first node N1. The second transistor T2 may be referred to as a scan transistor.

A third transistor T3 may have a gate electrode connected to a second scan line S2*i*, a first electrode connected to the second node N2, and a second electrode connected to a sensing line Ik. The third transistor T3 may be referred to as a sensing transistor.

The storage capacitor Cst may have a first electrode connected to the first node N1 and a second electrode connected to the second node N2.

The light emitting diode LD may have an anode connected to the second node N2 and a cathode connected to the second power line ELVSSL. The light emitting diode LD may be an organic light emitting diode, an inorganic light emitting diode, a quantum dot/well light emitting diode, or the like. In addition, the light emitting diode LD may be a plurality of light emitting diodes connected in series, in parallel, or in series and parallel.

During the display period, the voltage of the first power line ELVDDL may be greater than the voltage of the second power line ELVSSL. However, in special circumstances such as when preventing light from being emitted from the light emitting diode LD, the voltage of the second power line ELVSSL may be set equal to or greater than the voltage of the first power line ELVDDL.

Referring to FIG. 4, waveforms of signals applied to the scan lines S1*i* and S2*i*, the data line Dj, and the sensing line Ik connected to the pixel PXij during a horizontal period are shown as an example, where k may be an integer greater than 0. One frame period may include a plurality of horizontal periods corresponding to pixel rows.

An initialization voltage VINT may be applied to the sensing line Ik.

Data voltages DS(i−1)j, DSij, and DS (i+1)j may be sequentially applied to the data line Dj. The first scan signal of the turn-on level (logic high level) may be applied to the first scan line S1*i* in a corresponding horizontal period. Also, in synchronization with the first scan line S1*i*, the second scan signal of the turn-on level may be applied to the second scan line S2*i* as well.

For example, when the scan signals of the turn-on level are applied to the first scan line S1*i* and the second scan line S2*i*, the second transistor T2 and the third transistor T3 may be turned on. Accordingly, a voltage corresponding to a difference between a data voltage DSij and the initialization voltage VINT may be written in the storage capacitor Cst in the pixel PXij.

In this case, a difference between the initialization voltage VINT applied to the second node N2 and the second power voltage of the second power line ELVSSL may be smaller than a threshold voltage of the light emitting diode LD. Accordingly, at this time point, the light emitting diode LD may be in a non-emission state.

Thereafter, when the scan signals of a turn-off level (logic low level) is applied to the first scan line S1*i* and the second scan line S2*i*, the second transistor T2 and the third transistor T3 may be turned-off. Therefore, a voltage difference between a gate electrode and a source electrode of the first transistor T1 may be maintained by the storage capacitor Cst regardless of a change in voltage on the data line Dj.

Accordingly, a current path from the first power line ELVDDL to the second power line ELVSSL through the first transistor T1 and the light emitting diode LD may be formed. The luminance of light emitted from the light emitting diode LD may be determined according to a driving current flowing through the current path.

The driving current can be expressed as in Equation 1 below.

$$Ids=(1/2)*(W/L)*u*Cox*((Vdata-Vanode-Vth)^2)*(1+lmd*(Velvdd-Vanode)) \quad \text{[Equation 1]}$$

Here, Ids may be the driving current flowing through the first transistor T1, W may be a channel width of the first transistor T1, L may be a channel length of the first transistor T1, u may be the mobility of the first transistor T1, Cox may be the capacitance formed by the channel, the insulating layer, and the gate electrode of the first transistor T1, Vdata may be the data voltage DSij, Vanode may be an anode voltage of the light emitting diode LD, Vth may be a threshold voltage of the first transistor T1, lmd may be a constant, and Velvdd may be the voltage of the first power line ELVDDL.

In addition, Vanode can be expressed as in Equation 2 below.

$$Vanode=Velvss+Vel \quad \text{[Equation 2]}$$

Here, Velvss may be the second power voltage of the second power line ELVSSL, and Vel may be a voltage difference between the anode and the cathode of the light emitting diode LD.

The structure and driving method of the pixel PXij described with reference to FIGS. 1 to 4 may correspond to one embodiment. Embodiments described below may be applied to any pixel structure and driving method which are known to a person having ordinary skill in the art. For example, when the pixel PXij does not include the sensor 15 and the second scan lines S21, S22, and S2*n*, the embodiments described below may be equally applied to the pixel PXij.

Figure 5:
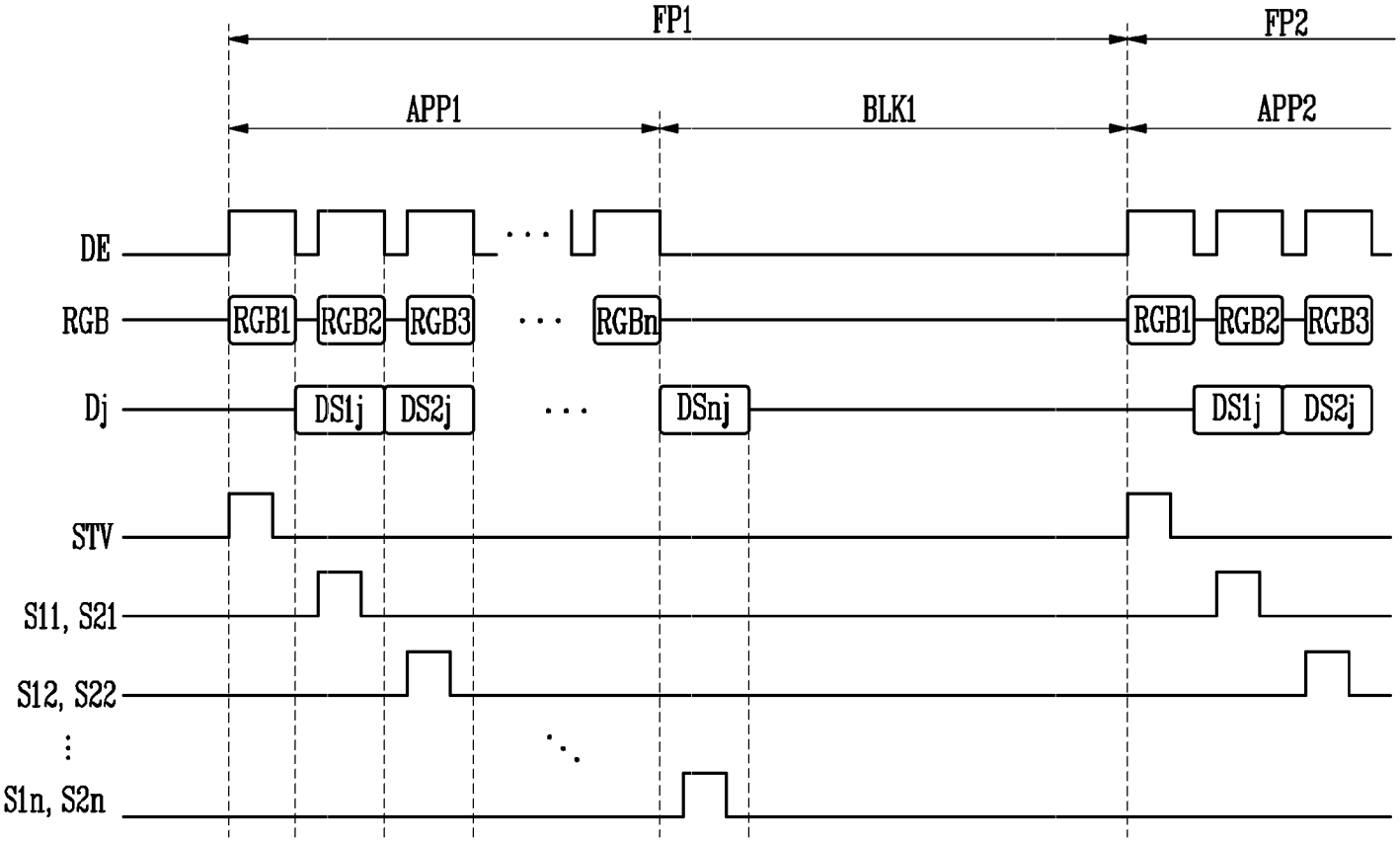
FIG. 5 is a diagram for explaining a driving method of the display device according to an embodiment of the present inventive concept.

FIG. 5 is a diagram for explaining a driving method of the display device according to an embodiment of the present inventive concept.

Referring to FIG. 5, successive first and second frame periods FP1 and FP2 are shown as an example. The first frame period FP1 may include a first active period APP1 and a first blank period BLK1. The second frame period FP2 may include a second active period APP2 and a second blank period. Hereinafter, description will be made based on the first frame period FP1, but this description can be equally applied to other frame periods.

In the first active period APP1, the data enable signal DE of an enable level (for example, a logic high level) may be sequentially supplied to the timing controller 11. In this case, grayscale data RGB1, RGB2, RGB3, and RGBn, each of which includes grayscale data of one pixel row, may be supplied in synchronization with respective data enable signal DE of the enable level.

The data driver 12 may receive processed or unprocessed grayscale data RGB1, RGB2, RGB3, and RGBn from the timing controller 11. According to an embodiment, the data driver 12 may generate the data voltages by serially receiving grayscale data RGB1 from the timing controller 11 and latching the grayscale data RGB1 one row at a time when the reception is completed. Among these data voltages, a j-th data voltage DS1*j* may be applied to a j-th data line Dj. Similarly, grayscale data RGB2 may be output as a data voltage DS2*j* in the next horizontal period, and grayscale data RGBn may be output as a data voltage DSnj in the $n^{th}$ horizontal period.

When a scan start signal STV of an enable level (for example, a turn-on level) is received, the scan driver 13 may sequentially provide the scan signals of the turn-on level to the scan lines S11, S21, S12, S22, S1*n*, and S2*n* connected to the pixels.

As the scan signals of the turn-on level (for example, the logic high level) are sequentially applied to the scan lines S11, S21, S12, S22, S1*n*, and S2*n*, the data voltages applied to the data lines may be written to the corresponding pixels. For example, when the scan signals of the turn-on level are applied to the scan lines S11 and S21, data voltages DS1*j*, . . . may be written to the pixels of a first horizontal line (or a first pixel row). Next, when the scan signals of the turn-on level are applied to the scan lines S12 and S22, data voltages DS2*j*, . . . may be written to the pixels of a second horizontal line (a second pixel row). By repeating this, when the scan signals of the turn-on level are applied to the scan lines S1*n* and S2*n*, data voltages DSnj, . . . may be written to the pixels of the last horizontal line (a last pixel row).

In the first blank period BLK1, the data enable signal DE of the disable level (for example, the logic low level) may be supplied. In this case, the supply of the grayscale data may be stopped.

Figure 6:
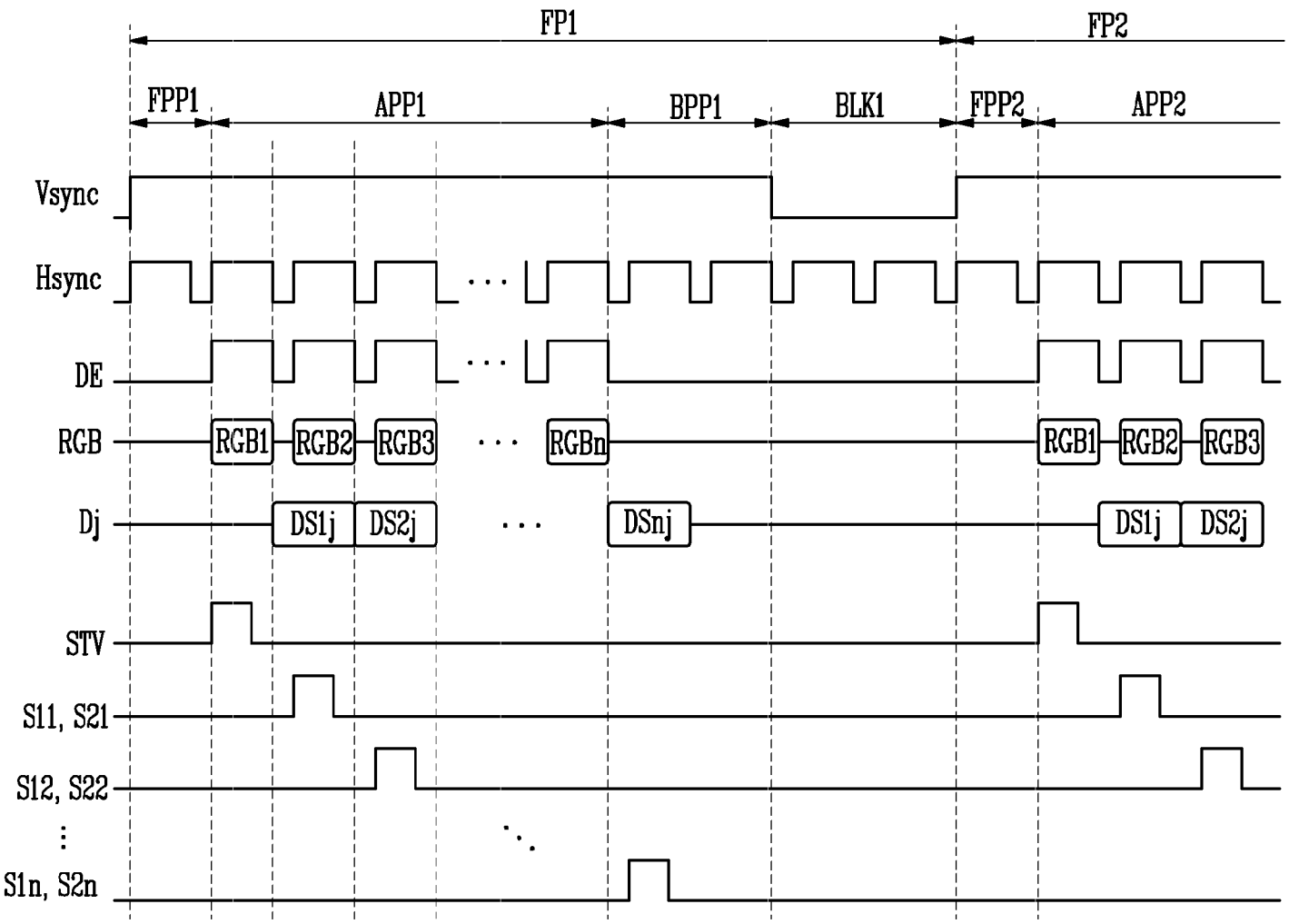
FIG. 6 is a diagram for explaining a driving method of the display device according to another embodiment of the present inventive concept.

FIG. 6 is a diagram for explaining a driving method of the display device according to another embodiment of the present inventive concept.

Referring to FIG. 6, the processor 10 may supply the vertical synchronization signal Vsync and the horizontal synchronization signal Hsync to the timing controller 11.

For example, the first frame period may include a first front porch period FPP1, a first active period APP1, a first back porch period BPP1, and a first blank period BLK1. For example, the second frame period may include a second front porch period FPP2, a second active period APP2, a second back porch period, and a second blank period.

For example, the first front porch period FPP1 may be a period in which the vertical synchronization signal Vsync is at the enable level (for example, the logic high level) and the data enable signal DE is at the disable level (for example, the logic low level), and may be a period before the supply of the grayscale data RGB1, RGB2, RGB3, and RGBn is started.

For example, the first active period APP1 may be a period in which the vertical synchronization signal Vsync is at the enable level and the data enable signal DE includes pulses of the enable level, and may be a period in which the grayscale data RGB1, RGB2, RGB3, and RGBn is supplied.

For example, the first back porch period BPP1 may be a period in which the vertical synchronization signal Vsync is at the enable level and the data enable signal DE is at the disable level, and may be a period after the supply of the grayscale data RGB1, RGB2, RGB3, and RGBn is finished.

For example, the first blank period BLK1 may be a period in which the vertical synchronization signal Vsync is at the disable level and the data enable signal DE is at the disable level.

Since descriptions of the data enable signal DE, the grayscale data RGB, the data voltages DS1*j*, DS2*j*, and DSnj, and the scan signals are the same as those of FIG. 5, duplicate descriptions will be omitted.

Figure 7:
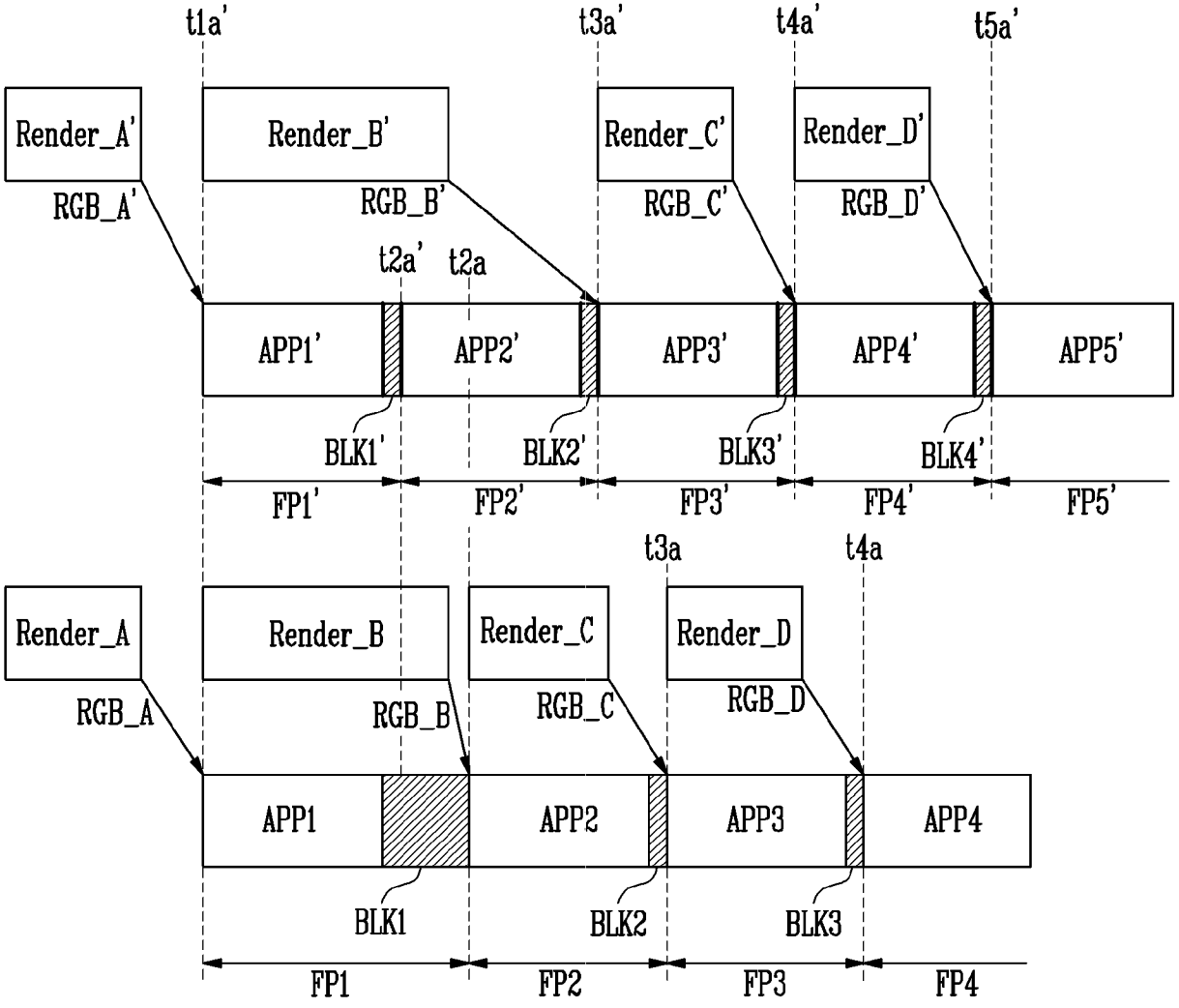
FIG. 7 is a diagram for explaining a method of matching a rendering speed and a display frequency according to an embodiment of the present inventive concept.

FIG. 7 is a diagram for explaining a method of matching a rendering speed and a display frequency according to an embodiment of the present inventive concept.

Referring to the upper part of FIG. 7, when a rendering speed and a display frequency do not correspond, a comparative example for matching them is shown. In the comparative example, blank periods BLK1', BLK2', BLK3', and BLK4' have the same length. Accordingly, in the comparative example, frame periods FP1', FP2', FP3', FP4', and FP5' have the same length. For explanation, it is assumed that rendering periods Render_A', Render_C', and Render_D' are shorter than a frame period and a rendering period Render_B' is longer than the frame period.

For example, the processor 10 may render an image A' during the rendering period Render_A'. At a time point t1*a*' after the rendering period Render_A' ends, grayscale data RGB_A' for the image A' may be provided to the timing controller 11. A first active period APP1' and a first blank period BLK1' of a first frame period FP1' may proceed in response to the grayscale data RGB_A' (refer to the driving method of FIG. 5 or FIG. 6). That is, a first frame may display the image A'.

After the time point t1*a*', the processor 10 may render an image B' during the rendering period Render_B'. For example, the rendering period Render_B' may be ended later than a time point t2*a*' at which a second frame period FP2' starts. If grayscale data RGB_B' is provided during a second active period APP2', a second frame simultaneously displays the image A' and the image B', which may cause a tearing issue that is a visual artifact in video display where a display device shows information from multiple frames in a single screen. Accordingly, the processor 10 may not provide the grayscale data RGB_B' during the second frame period FP2', and thus the second frame may display the image A'. Accordingly, a stuttering issue in which the first frame and the second frame display the same image A' may occur.

The processor 10 may provide the grayscale data RGB_B' for the image B' at a time point t3*a*' at which a third frame period FP3' starts. Accordingly, a third frame may display the image B'.

Similarly, grayscale data RGB_C' for an image C' may be provided at a time point t4*a*' so that a fourth frame may display the image C', and grayscale data RGB_D' for an image D' may be provided at a time point t5*a*' so that a fifth frame may display the image D'.

Referring to the lower part of FIG. 7, an embodiment in which the rendering speed and the display frequency, which do not correspond each other, are matched is shown. In the present embodiment, blank periods BLK1, BLK2, and BLK3 may have different lengths. Accordingly, in the present embodiment, frame periods FP1, FP2, FP3, and FP4 may have different lengths. Similarly, it is assumed that rendering periods Render_A, Render_C, and Render_D are shorter than the active period (APP1, APP2, APP3 and APP4) and a rendering period Render_B is longer than the active period (APP1, APP2, APP3 and APP4).

The processor 10 may provide grayscale data RGB_A for an image A at the time point t1*a*' so that the first frame may display the image A.

When the rendering period Render_B for an image B has not ended at the time point t2*a*', the processor 10 may extend the length of the first blank period BLK1. For example, the processor 10 may extend the length of the first blank period BLK1 by extending a period for maintaining the data enable signal DE at the disable level (refer to FIGS. 5 and 6). Meanwhile, the processor 10 may extend the length of the first blank period BLK1 by extending a period for maintaining the vertical synchronization signal Vsync at the disabled level (refer to FIG. 6).

The processor 10 may provide grayscale data RGB_B at a time point t2*a* after the rendering period Render_B ends. Accordingly, the second frame may display the image B. Meanwhile, the third frame may display an image C, and the fourth frame may display an image D.

According to the present embodiment, there is an advantage that images can be displayed faster than the comparative example without the tearing and stuttering issues.

Figure 8:
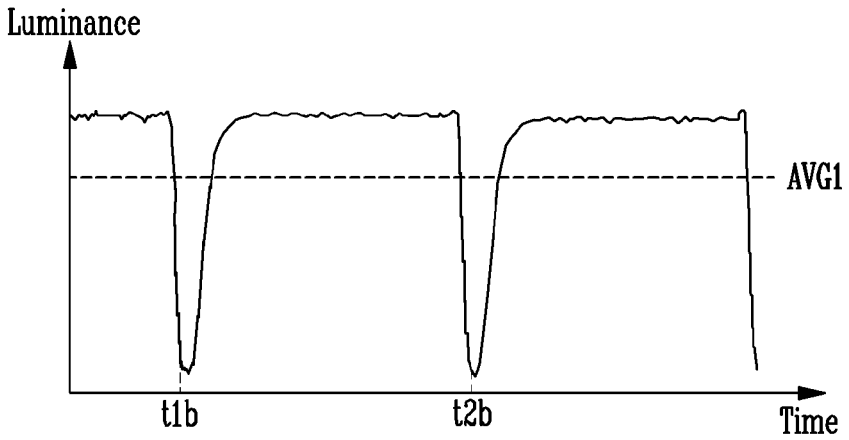
FIG. 8 is a diagram for explaining a change in luminance of one pixel when the display frequency is relatively low.
Figure 9:
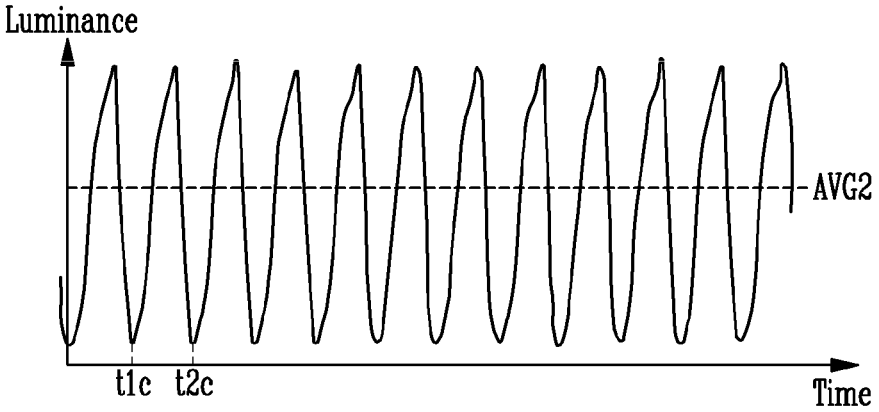
FIG. 9 is a diagram for explaining a change in luminance of one pixel when the display frequency is relatively high.

FIG. 8 is a diagram for explaining a change in luminance of one pixel when the display frequency is relatively low. FIG. 9 is a diagram for explaining a change in luminance of one pixel when the display frequency is relatively high.

Referring to FIG. 8, for example, a time point t1*b* may be a time point at which the initialization voltage VINT is applied to the second node N2 of the pixel PXij in one horizontal period. As described above, in this case, since the light emitting diode LD is in the non-emission state, the luminance of the pixel PXij may decrease.

A time point t2*b* may be a time point at which the initialization voltage VINT is applied to the second node N2 of the pixel PXij in the next horizontal period subsequent to the one horizontal period. As described above, in this case, since the light emitting diode LD is in the non-emission state, the luminance of the pixel PXij may decrease. [0115] Similarly in the case of FIG. 9, time points t1*c* and t2*c* may be time points when the light emitting diode LD is in the non-emission state in each horizontal period. Since FIG. 8 is a case where the display frequency is relatively low (that is, when the frame period is relatively long), and FIG. 9 is a case where the display frequency is relatively high (that is, when the frame period is relatively short), periods between t1*c* and t2*c* may be shorter than periods between t1*b* and t2*b*. A non-emission period of the light emitting diode LD in a same time period may be longer in the case of FIG. 9 than in the case of FIG. 8. Accordingly, average luminance AVG2 in the case of FIG. 9 may be lower than average luminance AVG1 in the case of FIG. 8. That is, the higher the display frequency, the lower the average luminance, and the lower the display frequency, the higher the average luminance. Therefore, it is necessary to compensate for these cases.

Accordingly, when the display frequency is lowered, it is necessary to compensate so that the luminance is lowered. Referring to Equations 1 and 2, when the voltage Velvdd of the first power line ELVDDL is lowered, the driving current Ids may be reduced. Meanwhile, in some periods, the driving current Ids may be cut off by making the voltage Velvdd of the first power line ELVDDL equal to the second power voltage of the second power line ELVSSL.

Figure 10:
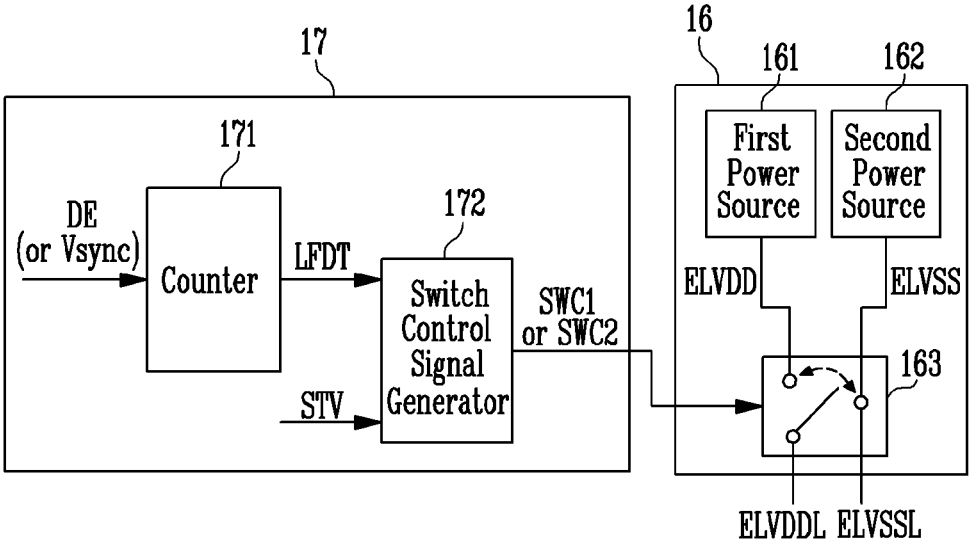
FIG. 10 is a diagram for explaining a switch controller and a power supply according to an embodiment of the present inventive concept.

FIG. 10 is a diagram for explaining a switch controller and a power supply according to an embodiment of the present inventive concept.

The switch controller 17 may generate a first switch control signal SWC1 when the blank period is longer than a predetermined period, and generate a second switch control signal SWC2 when the blank period ends. In an embodiment, the switch controller 17 may maintain the second switch control signal SWC2 when the blank period is shorter than the predetermined period.

The switch controller 17 may include a counter 171 and a switch control signal generator 172.

The counter 171 may generate a low frequency detection signal LFDT when the blank period is longer than the predetermined period. For example, the counter 171 may generate the low frequency detection signal LFDT when a time for which the data enable signal DE is maintained at the disable level is longer than the predetermined period. For example, the counter 171 may count the time during which the data enable signal DE is maintained at the disable level by using a clock signal. At this time, when the counted number exceeds a reference count value, the counter 171 may generate the low frequency detection signal LFDT.

In another embodiment, the counter 171 may generate the low frequency detection signal LFDT when a time for which the vertical synchronization signal Vsync is maintained at the disabled level is longer than the predetermined period. For example, the counter 171 may count the time during which the vertical synchronization signal Vsync is maintained at the disabled level by using a clock signal. At this time, when the counted number exceeds the reference count value, the counter 171 may generate the low frequency detection signal LFDT. In this case, the counter 171 may use the horizontal synchronization signal Hsync instead of the clock signal for counting the time during which the data enable signal DE is maintained at the disable level and the vertical synchronization signal Vsync is maintained at the disabled level.

The switch control signal generator 172 may generate the first switch control signal SWC1 when the low frequency detection signal LFDT is received, and generate the second switch control signal SWC2 when the scan start signal STV of the enable level is received.

The power supply 16 may supply a voltage different from a first power voltage ELVDD to the first power line ELVDDL when the first switch control signal SWC1 is received, and supply the first power voltage ELVDD to the first power line ELVDDL when the second switch control signal SWC2 is received. In the embodiment of FIG. 10, the power supply 16 may supply a second power voltage ELVSS to the first power line ELVDDL when the first switch control signal SWC1 is received. The first power voltage ELVDD may be greater than the second power voltage ELVSS.

The power supply 16 may include a first power source 161, a second power source 162, and a switch 163.

The first power source 161 may generate the first power voltage ELVDD. For example, the first power source 161 may be a boost converter. However, the first power source 161 is not necessarily implemented as a boost converter which includes a DC-DC converter. For example, the first power source 161 may be independently implemented as a power management integrated chip (PMIC), and the first power source 161 may generate the first power voltage ELVDD by receiving the first power voltage ELVDD from the PMIC.

The second power source 162 may generate the second power voltage ELVSS. For example, the second power source 162 may be a buck-boost converter. However, the second power source 162 is not necessarily implemented as the buck-boost converter which includes a DC-DC converter. For example, the DC-DC converter may be independently implenented as a PMIC, and the second power source 162 may generate the second power voltage ELVSS by receiving the second power voltage ELVSS from the PMIC.

The switch 163 may connect the first power line ELVDDL to the second power source 162 when the first switch control signal SWC1 is received, and connect the first power line ELVDDL to the first power source 161 when the second switch control signal SWC2 is received.

Figure 11:
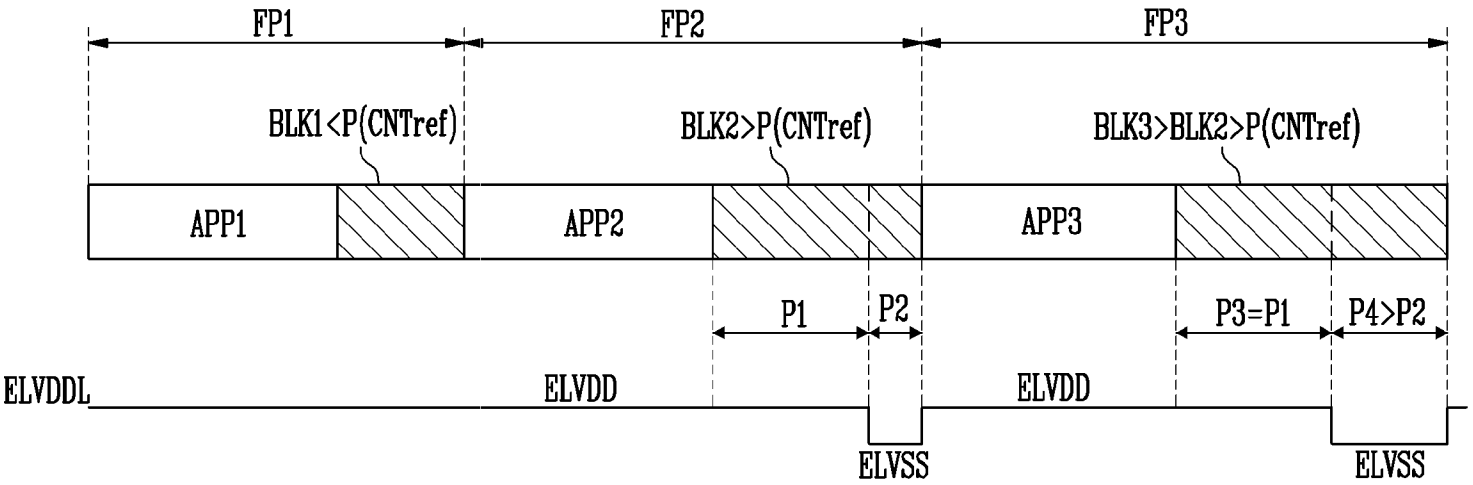
FIGS. 11 and 12 are diagrams for explaining an example of luminance correction according to the display frequency.
Figure 12:
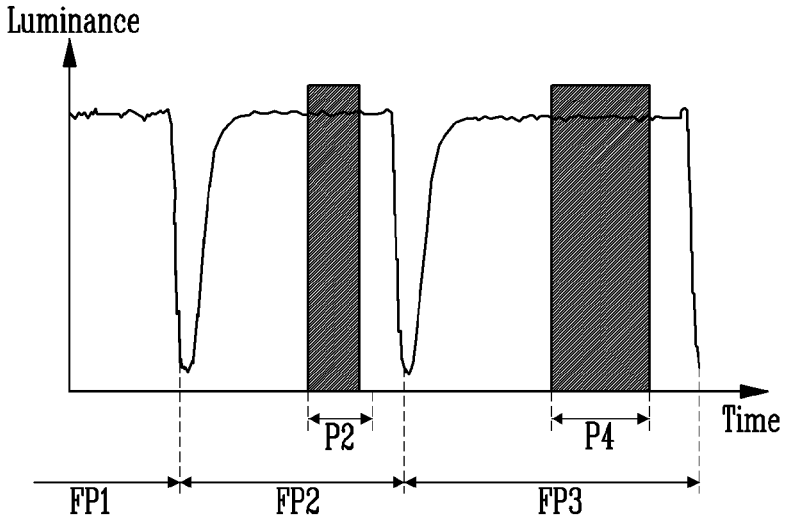

FIGS. 11 and 12 are diagrams for explaining an example of luminance correction according to the display frequency.

Referring to FIG. 11, three consecutive frame periods FP1, FP2, and FP3 are shown as an example. A first frame period FP1 may include a first active period APP1 and a first blank period BLK1. A second frame period FP2 may include a second active period APP2 and a second blank period BLK2. A third frame period FP3 may include a third active period APP3 and a third blank period BLK3.

Here, it is assumed that the second frame period FP2 is longer than the first frame period FP1 and the third frame period FP3 is longer than the second frame period FP2. That is, it is assumed that the display frequency decreases over time. The active periods APP1, APP2, and APP3 may have the same length, and at least two of the blank periods BLK1, BLK2, and BLK3 may have different lengths. Here, it is assumed that the second blank period BLK2 is longer than the first blank period BLK1 and the third blank period BLK3 is longer than the second blank period BLK2. Here, it is assumed that the first blank period BLK1 is shorter than a predetermined period P(CNTref), and the second blank period BLK2 and the third blank period BLK3 are longer than the predetermined period P(CNTref). The predetermined period P(CNTref) may mean a time taken until a value counted by the counter 171 becomes equal to a reference count value CNTref.

First, since the first blank period BLK1 is shorter than the predetermined period P(CNTref), the counter 171 may not generate the low frequency detection signal LFDT. Accordingly, during the first blank period BLK1, the first power line ELVDDL may maintain the first power voltage ELVDD.

Next, since the second blank period BLK2 is longer than the predetermined period P(CNTref), the counter 171 may generate the low frequency detection signal LFDT. The switch control signal generator 172 receiving the low frequency detection signal LFDT may generate the first switch control signal SWC1 when a first period P1 has elapsed from the start of the second blank period BLK2. The switch 163 may connect the first power line ELVDDL to the second power source 162. In this case, the first period P1 and the predetermined period P(CNTref) may be substantially the same. The first period P1 may be longer than the first blank period BLK1. Accordingly, the first power line ELVDDL may maintain the first power voltage ELVDD during the first period P1 of the second blank period BLK2 and the first power line ELVDDL may maintain a voltage ELVSS lower than the first power voltage ELVDD during a second period P2 of the second blank period BLK2. Accordingly, the plurality of pixels 14 may be in the non-emission state during the second period P2. The second period P2 may be a period between the first period P1 and the third active period APP3.

Next, as the second blank period BLK2 ends and the third active period APP3 begins, the scan start signal STV of the enable level may be supplied to the scan driver 13. Accordingly, the switch control signal generator 172 receiving the scan start signal STV of the enable level may generate the second switch control signal SWC2. Accordingly, the switch 163 may connect the first power line ELVDDL to the first power source 161, and the first power voltage ELVDD may be applied to the first power line ELVDDL. Accordingly, the plurality of pixels 14 may be in an emission state again.

Next, since the third blank period BLK3 is longer than the predetermined period P(CNTref), the counter 171 may generate the low frequency detection signal LFDT. The switch control signal generator 172 receiving the low frequency detection signal LFDT may generate the first switch control signal SWC1 when a third period P3 has elapsed from the start of the third blank period BLK3. The switch 163 may connect the first power line ELVDDL to the second power source 162. In this case, the third period P3 and the predetermined period P(CNTref) may be substantially the same. Accordingly, the first period P1 and the third period P3 may be the same. Accordingly, the first power line ELVDDL may maintain the first power voltage ELVDD during the third period P3 of the third blank period BLK3 and the first power line ELVDDL may maintain the voltage ELVSS lower than the first power voltage ELVDD during a fourth period P4 of the third blank period BLK3. Accordingly, the plurality of pixels 14 may be in the non-emission state during the fourth period P4. The fourth period P4 may be a period between the third period P3 and a fourth active period. The fourth period P4 may be longer than the second period P2.

Referring to FIG. 12, there is no non-emission period added during the first frame period FP1, but the second frame period FP2 may have the non-emission period of the second period P2, and the third frame period FP3 may have the non-emission period of the fourth period P4.

Accordingly, in a frame period in which the display frequency is relatively low, the non-emission period becomes relatively long, so that the average luminance in the frame period in which the display frequency is relatively low can be reduced. Accordingly, since the average luminance can be maintained similarly regardless of a change in the display frequency, the occurrence of flicker can be prevented.

Figure 13:
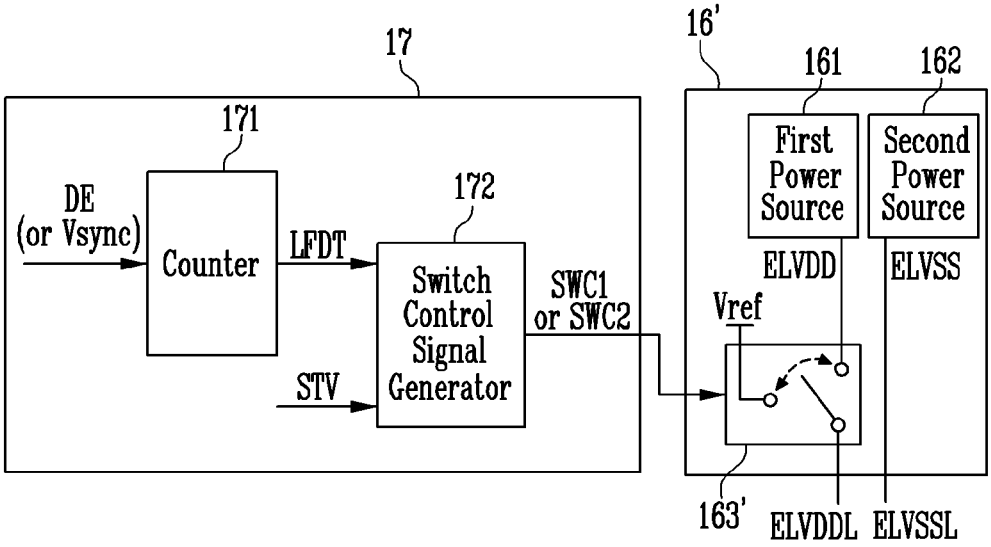
FIG. 13 is a diagram for explaining a switch controller and a power supply according to another embodiment of the present inventive concept.

FIG. 13 is a diagram for explaining a switch controller and a power supply according to another embodiment of the present inventive concept. Hereinafter, only a configuration different from that of the embodiment of FIG. 10 will be described, and duplicate descriptions of the same configurations will be omitted.

Referring to FIG. 13, when the first switch control signal SWC1 is received, a power supply 16' may supply a reference voltage Vref to the first power line ELVDDL. In this case, the reference voltage Vref may be a different (independent) voltage from the first power voltage ELVDD and the second power voltage ELVSS. The first power voltage ELVDD may be greater than the reference voltage Vref. The reference voltage Vref may be greater than the second power voltage ELVSS.

A switch 163' may apply the reference voltage Vref to the first power line ELVDDL when the first switch control signal SWC1 is received, and may connect the first power line ELVDDL to the first power source ELVDD 161 when the second switch control signal SWC2 is received.

Since operations of the switch controller 17 and the power supply 16' of FIG. 13 may be the same as those of FIGS. 11 and 12, descriptions of overlapping features will be omitted.

According to the display device and the driving method thereof of the present inventive concept, even if the frame memory is not provided, flicker can be prevented when the display frequency changes.

The drawings referred to heretofore and the detailed description of the inventive concept described above are merely illustrative of the inventive concept. It is to be understood that the inventive concept has been disclosed for illustrative purposes only and is not intended to limit the meaning or scope of the inventive concept as set forth in the claims. Therefore, those skilled in the art will appreciate that various modifications and equivalent embodiments are possible without departing from the scope of the inventive concept. Accordingly, the true technical protection scope of the inventive concept should be determined by the technical idea of the appended claims.

What is claimed is:

1. A display device comprising:

a processor supplying grayscale data in active periods of frame periods and stopping supply of the grayscale data in blank periods of the frame periods;

a switch controller generating a first switch control signal when a blank period is longer than a predetermined period, and generating a second switch control signal when the blank period ends;

a power supply supplying a voltage different from a first power voltage to a first power line when the first switch control signal is received and supplying the first power voltage to the first power line when the second switch control signal is received; and pixels commonly connected to the first power line, wherein lengths of the active periods of the frame periods are equal to each other, wherein at least two of the blank periods of the frame periods have different lengths, wherein the blank periods include a first blank period and a second blank period, wherein the first power line maintains the first power voltage during the first blank period, wherein the first power line maintains the first power voltage during a first period of the second blank period, and the first power line maintains the voltage different from the first power voltage during a second period of the second blank period, and wherein the first period is longer than the first blank period.

2. The display device of claim 1, wherein the power supply supplies a second power voltage lower than the first power voltage to the first power line when the first switch control signal is received, and wherein the pixels are commonly connected to a second power line to which the second power voltage is applied.

3. The display device of claim 2, wherein the first power voltage is greater than the second power voltage.

4. The display device of claim 2, wherein the power supply includes:

a first power source generating the first power voltage;

a second power source generating the second power voltage; and a switch connecting the first power line to the second power line when the first switch control signal is received, and connecting the first power line to the first power source when the second switch control signal is received.

5. The display device of claim 1, wherein the power supply supplies a reference voltage lower than the first power voltage to the first power line when the first switch control signal is received, Wherein the pixels are commonly connected to a second power line to which a second power voltage is applied, and wherein the reference voltage is different from the first power voltage and the second power voltage.

6. The display device of claim 5, wherein the first power voltage is greater than the reference voltage.

7. The display device of claim 5, wherein the power supply includes:

a first power source generating the first power voltage;

a second power source generating the second power voltage; and a switch applying the reference voltage to the first power line when the first switch control signal is received, and connecting the first power line to the first power source when the second switch control signal is received.

8. The display device of claim 1, wherein the blank periods further include a third blank period, wherein the first power line maintains the first power voltage during a third period of the third blank period, and the first power line maintains the voltage different from the first power voltage during a fourth period of the third blank period, wherein lengths of the third period and the first period are equal to each other, and wherein the fourth period is longer than the second period.

9. The display device of claim 8, wherein the pixels are in a non-emission state during the second period and the fourth period.

10. A display device comprising:

a processor supplying grayscale data in active periods of frame periods and stopping supply of the grayscale data in blank periods of the frame periods;

a switch controller generating a first switch control signal when a blank period is longer than a predetermined period, and generating a second switch control signal when the blank period ends;

a power supply supplying a voltage different from a first power voltage to a first power line when the first switch control signal is received and supplying the first power voltage to the first power line when the second switch control signal is received; and pixels commonly connected to the first power line, wherein the switch controller includes:

a counter generating a low frequency detection signal when the blank period is longer than the predetermined period; and a switch control signal generator generating the first switch control signal when the low frequency detection signal is received and generating the second switch control signal when a scan start signal is received.

11. The display device of claim 10, wherein the counter generates the low frequency detection signal when a data enable signal having a disable level is longer than the predetermined period.

12. The display device of claim 10, wherein the counter generates the low frequency detection signal when a vertical synchronization signal having a disabled level is longer than the predetermined period.

13. The display device of claim 10, further comprising:

a scan driver sequentially providing scan signals of a turn-on level to scan lines connected to the pixels when the scan start signal is received.

14. A driving method of a display device comprising:

supplying grayscale data in an active period of a frame period and stopping supply of the grayscale data in a blank period of the frame period by a processor;

generating a first switch control signal by a switch controller when the blank period is longer than a predetermined period;

supplying a voltage different from a first power voltage to a first power line by a power supply when the first switch control signal is received;

receiving the voltage different from the first power voltage by pixels commonly connected to the first power line;

generating a second switch control signal by the switch controller when the blank period ends;

supplying the first power voltage to the first power line by the power supply when the second switch control signal is received; and receiving the first power voltage by the pixels, wherein the processor supplies the grayscale data in active periods of frame periods and stops supply of the grayscale data in blank periods of the frame periods, wherein lengths of the active periods are equal to each other, wherein at least two of the blank periods have different lengths, wherein the blank periods include a first blank period and a second blank period, wherein the first power line maintains the first power voltage during the first blank period, wherein the first power line maintains the first power voltage during a first period of the second blank period, and the first power line maintains the voltage different from the first power voltage during a second period of the second blank period, and wherein the first period is longer than the first blank period.

15. The driving method of claim 14, wherein the blank periods further include a third blank period, wherein the first power line maintains the first power voltage during a third period of the third blank period, and the first power line maintains the voltage different from the first power voltage during a fourth period of the third blank period, wherein lengths of the third period and the first period are equal to each other, and wherein the fourth period is longer than the second period.

16. The driving method of claim 15, wherein the pixels are in a non-emission state during the second period and the fourth period.

* * * * *